US008968056B2

(12) United States Patent
Reut et al.

(10) Patent No.: US 8,968,056 B2
(45) Date of Patent: Mar. 3, 2015

(54) SYSTEM FOR MACHINING THE RUNNING SURFACE ON SKIS AND SNOWBOARDS

(75) Inventors: Mario Reut, Mauren (CH); Patrick Jung, St. Gallen (CH)

(73) Assignee: Spuhl AG, Wittenbach (CH)

( * ) Notice: Subject to any disclaimer, the term of this patent is extended or adjusted under 35 U.S.C. 154(b) by 225 days.

(21) Appl. No.: 13/605,246

(22) Filed: Sep. 6, 2012

(65) Prior Publication Data

US 2013/0178136 A1 Jul. 11, 2013

(30) Foreign Application Priority Data

Jan. 10, 2012 (CH) ..... 0045/12

(51) Int. Cl.
*B24B 53/07* (2006.01)

(52) U.S. Cl.
USPC ..... 451/72; 451/262; 451/263; 451/57; 451/58; 451/443

(58) Field of Classification Search
CPC ..... B24B 53/07; B24B 53/12; B24B 53/00; B24B 53/02; B24B 53/14; B24B 3/54; B24B 3/36; B24B 3/38; B24B 3/40; B24B 2/003; B24B 2/006
USPC ..... 451/5, 8–20, 57–58, 72, 262, 263, 443, 451/450
See application file for complete search history.

(56) References Cited

U.S. PATENT DOCUMENTS

| | | | | | |
|---|---|---|---|---|---|
| 2,384,777 | A * | 9/1945 | Westman | 451/296 |
| 4,577,586 | A * | 3/1986 | Morris et al. | 118/63 |
| 4,869,024 | A * | 9/1989 | Gladek | 451/213 |
| 4,881,347 | A * | 11/1989 | Mario et al. | 451/72 |
| 4,934,108 | A * | 6/1990 | Hall | 451/358 |
| 4,939,873 | A * | 7/1990 | Smialek | 451/28 |
| 5,088,239 | A * | 2/1992 | Osman | 451/5 |
| 5,203,118 | A | 4/1993 | Bocquet | |
| 5,209,780 | A | 5/1993 | Partel | |
| 5,597,344 | A * | 1/1997 | Bocquet | 451/65 |
| 7,070,479 | B2 * | 7/2006 | Faustmann et al. | 451/21 |
| 7,249,993 | B2 * | 7/2007 | Wagner | 451/11 |

FOREIGN PATENT DOCUMENTS

| | | |
|---|---|---|
| DE | 1627085 A1 | 3/1970 |
| EP | 0671189 | 9/1995 |
| EP | 1438994 A1 | 7/2004 |
| EP | 1685880 A1 | 8/2006 |
| FR | 1594036 A | 6/1970 |

* cited by examiner

*Primary Examiner* — George Nguyen
(74) *Attorney, Agent, or Firm* — Shook, Hardy & Bacon LLP

(57) ABSTRACT

The system for machining the bottom of skis comprises a machine frame, in which a ski is stationary supported by roller carriers. The machining is performed by machining tools on a carriage, which extends throughout under the ski. During the machining, the carrier rollers that are alternately arranged behind each other, take over the support of the ski. There are always so many carrier rollers directly under the ski that its bottom remains in a stationary position.

8 Claims, 6 Drawing Sheets

SYSTEM FOR MACHINING THE RUNNING SURFACE ON SKIS AND SNOWBOARDS

CROSS-REFERENCE TO RELATED APPLICATIONS

This nonprovisional application claims priority to Swiss Application No. 00045/12, filed Jan. 10, 2012.

TECHNICAL FIELD

The invention provides a system for machining the running surface on skis and snowboards.

BACKGROUND

The running surface of skis and snowboards, by a general term called skis, are exposed on hard snow slopes, especially in snow-poor areas, to high mechanical strain, thereby the running characteristics being negatively influenced, i.e., the frictional resistance increases. In high-performance skis, the running surface is not completely smooth; rather it usually has a structure in the form of grooves or other patterns, which is on the one hand caused by wear and tear by hard ice crystals of snow, or just due to damage of other kinds. In order to give the ski again the original properties or to adapt it to special conditions (soft snow or hard snow), devices are known that renew the original structure or produce a structure at the request of the skier by grinding and subsequent machining Together with the structuring of the running surface, there must also be re-sharpened the steel edges and/or changed the angle of the outer edge to the bottom.

For many years, there have been commercially available different devices, in which the skis are inserted at one end of the device and then passed through various machining stations. Such systems are suitable for machining thousands of skis each year, but not for smaller businesses, such as sporting goods stores, service stations, etc. Simple known devices are capable to grind the running surface and, simultaneously, by the grinding disks, the steel edges on its lower surface are ground to flush with the running surface. Larger systems are also equipped so that the lateral edges are ground into a new fixed angle. Here, the devices must capture the contours of today's most highly specialized skis and the grinding disks are then led along these contours.

One technical task of the present invention is now to create a system that allows performing all machining steps in a small space, while an optimal running surface is produced in which both the running surface and the lateral edges are adaptable to the respective requirements.

This technical task is solved by a system according to the features of patent claim 1. Advantageous embodiments of the system are described in the dependent claims.

This process succeeds by holding a ski with a downward facing running surface or bottom in the center of machine frame while a carriage holding the machining tools is passing under the fixed ski and processes the surface with a very narrow tolerance that does not damage the ski bottom covering. The ski is constantly supported by a variety of carrier rollers, and during the machining keeps the required alignment. The carrier rollers, movably mounted in the machine frame and arranged at very short mutual distances, can reliably carry the ski thereby preventing the ski from being bent when the machining tools are applied. The positioning of the ski in the machine frame is ensured by partly fixed and partly moving carrier rollers so that the ski is always precisely aligned, when the machining tools are passed under the ski.

The machining tools are guided by distance sensors at a set distance to the ski and along the bottom and the mostly curved side edges. In order to maintain an optimal surface of the machining tools, they are newly whetted with a whetting member, for example with a diamond, which is fixed on the machine frame, in time-selectable intervals and/or patterns are formed on the grinding disks in order to achieve corresponding finish or structures on the running surface of the skis. The whetting element is preferably supplied with cooling water from a through bore, thus reducing the wear and the development of heat. In the area of the lower apex of the grinding disks, they are cleaned with a water jet precisely directed to the grinding disk surface, i.e., the sanding dust and any debris are continuously removed from the grinding disks before the latter again come into contact with the ski. In order to avoid errors due to unbalance, particularly of the sliding surface and structure-grinding disk, with which the cover is being processed, means for detecting and/or correcting the unbalance may be provided.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

Figure 5:
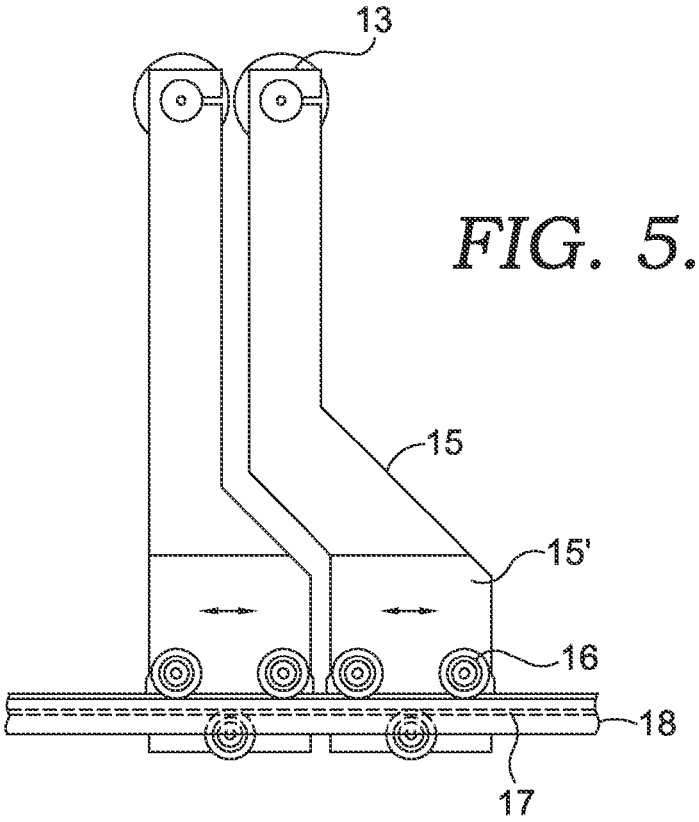
FIG. 5 is a side view of the stand and carrier rollers as shown in FIG. 1 on the left side.
Figure 6:
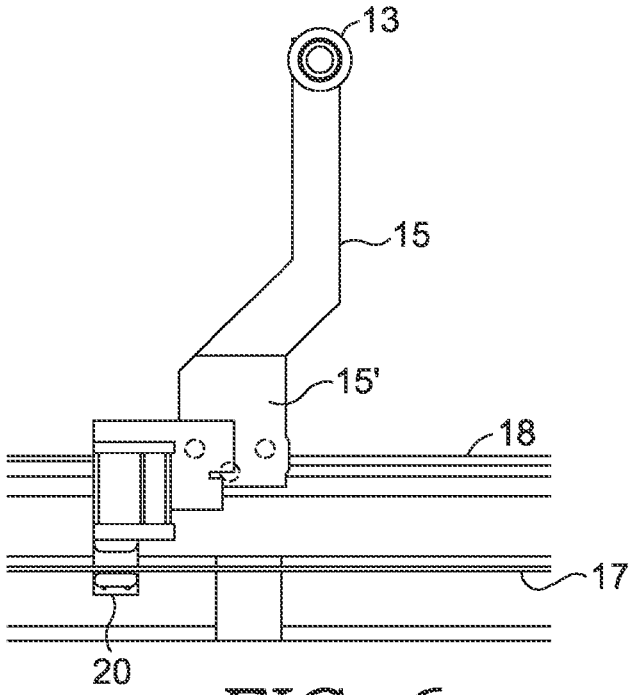
FIG. 6 is a view of a stand and a carrier roller, and the clamping element.
Figure 7:
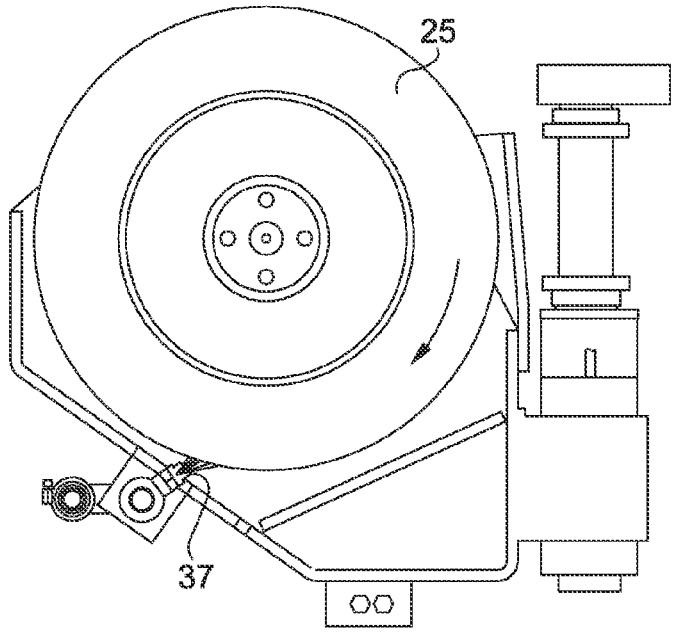
FIG. 7 shows a view of a cleaning nozzle at the sliding surface and structure-grinding disk.
Figure 8:
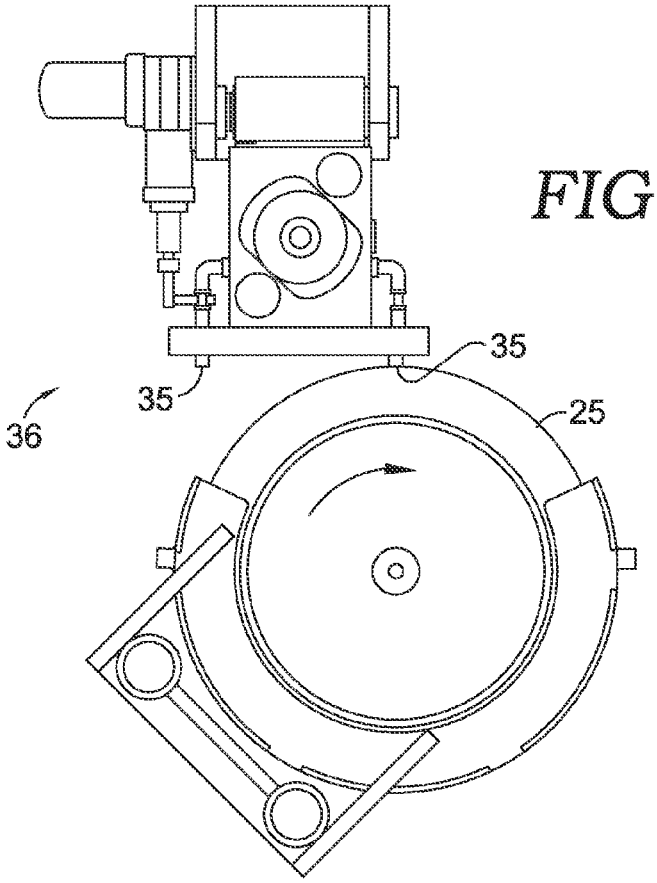
FIG. 8 is a side view of the whetting device for the grinding disks.

In the figures, with the reference numeral 1, a system for the machining of the running surface on skis and snowboards, broadly referred to as skis 5 throughout the specification, is presented. The system 1 comprises a machine frame 3, which is supported on the floor of the room by the frame support 7. In the central part of a machine frame 3 having a rectangular cross-section, there are arranged downwardly acting pneumatic or hydraulic pressing cylinders 9 on a suitably designed base 11. The pressing cylinders 9 are used to press the ski 5 to the carrier roller 13 located under it in such a way that the ski 5 or its bottom 21 is pressed from its domed shape into an elongated, linear position. The carrier rollers 13 are rotatably mounted on shafts on stands 15, so rollers 13 are free to rotate. As best seen in FIG. 5, the stands 15 have at their lower ends a widening 15', in which the roller pairs 16 are mounted, which are guided on two parallel rails 18 in the machine frame 3. In the area of the rails 18, there extends a band or cogged belt 17. The individual stands 15 with the carrier rollers 13 are designed such that, with suitable clamping mechanisms 20, they can be connected to and again detached from the cogged belt 17. Also, however firmly connected to the cogged belt 17, there is arranged a carriage 19, on which are arranged the cutting tools for the machining of the bottom 21 and the edges 23 of the clamped ski 5.

Figure 1:
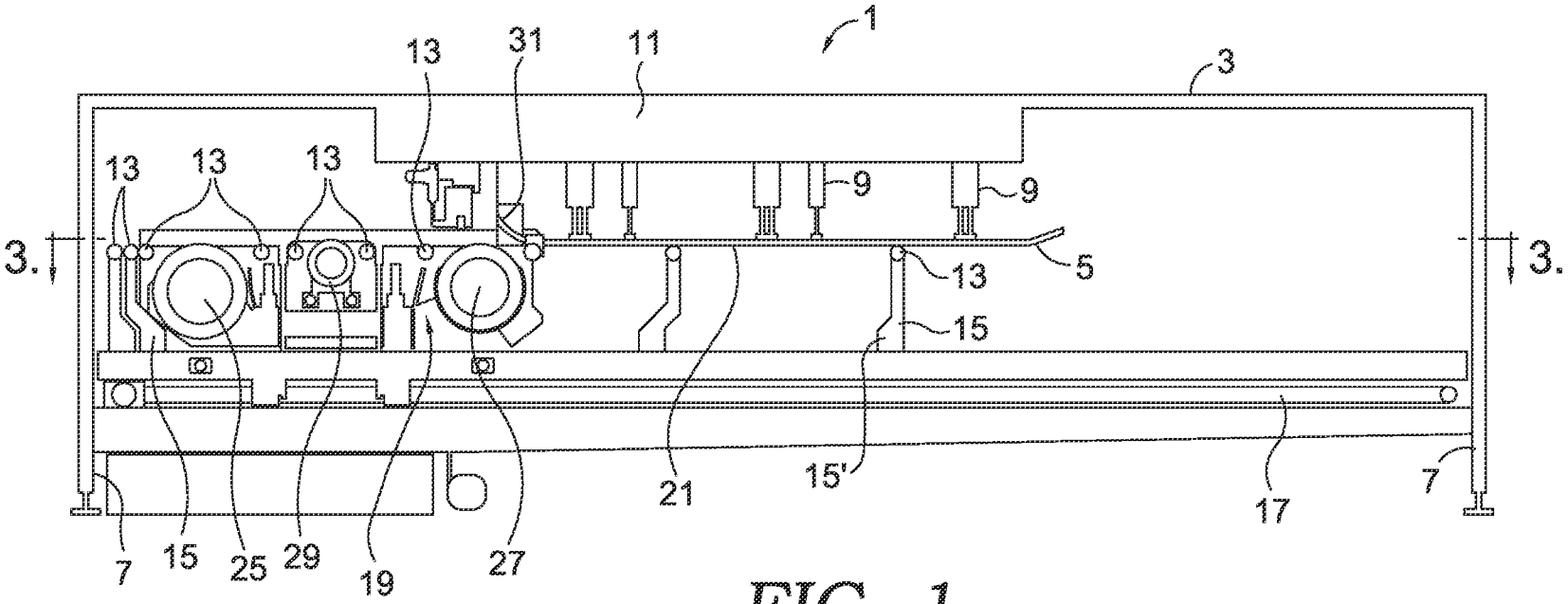
FIG. 1 shows a side view of the system after inserting a ski.
Figure 2:
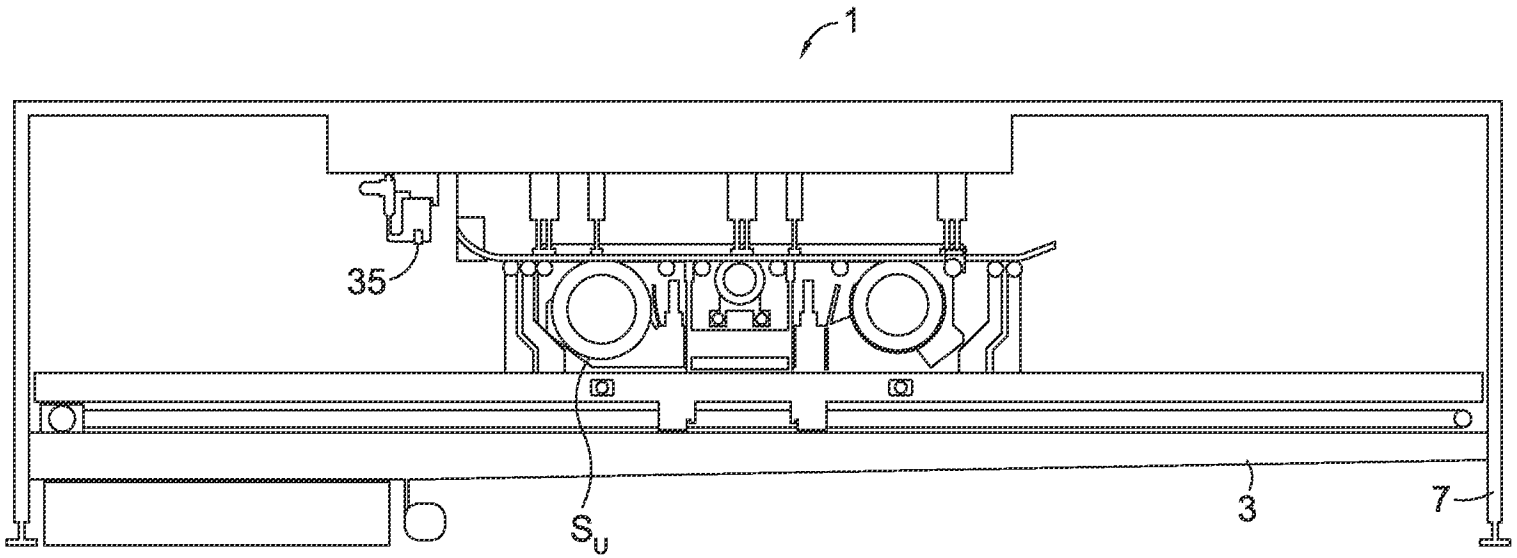
FIG. 2 shows a side view of the system during the machining of the ski.

In FIG. 2 on the right side of the carriage 19, there are arranged, for example, two more stands 15 with carrier rollers 13, and in contrast to the two stands 15 with roller carriers 13 on the left side, they are pushed together on the right side of the carriages 19. Also on the carriage 19 are mounted carrier rollers 13 which thus can move along with the carriage 19. The carriage 19 is supported by rollers (not shown), which, for example, roll on the same rails 18 as the stand 15 for the carrier rollers 13. The two stands 15 located on the left side of the carriages 19 are provided with clamping means 20, with which a temporary connection to the cogged belt 17 can be established. The control of the clamping means 20 is ensured via flexible control and power cables.

On the carriage 19, on the left side, there is arranged a sliding surface and structure grinding disk 25 with a drive motor. On the right side of the carriage 19, tuning grinding disks 27 are arranged on overhung shafts, each with a drive motor. Between the sliding surface and structure-grinding disk 25 and the tuning grinding disk 27 are in turn mounted, on driven shaft stubs, cup wheels 29 on the carriage 19. The sliding surface and structure-grinding disk 25 and the tuning grinding disks 27 are mounted with possible vertical adjustment and can be moved, with a predetermined force, to the bottom 21 and/or the edges 23 of the ski 5 and pressed to it. The two tuning grinding disks 27 can also be moved in the axial direction into an optimal position in order to completely cover the entire course of the edges 23, which, as is well known, in the case of modern skis 5 are non-linear but rather curved. The same applies to the two cup wheels 29, which can be simultaneously moved to the outer edges, i.e., substantially perpendicular to the bottom 21 extending edges 23, and can be pneumatically pressed to them. Furthermore, the axes of rotation of the tuning grinding disks 27 can be pivoted from the horizontal position into an acute angle. This allows changing the angle between the lower edge surface in the bottom plane and the lateral surfaces of the edges 23.

Figure 3:
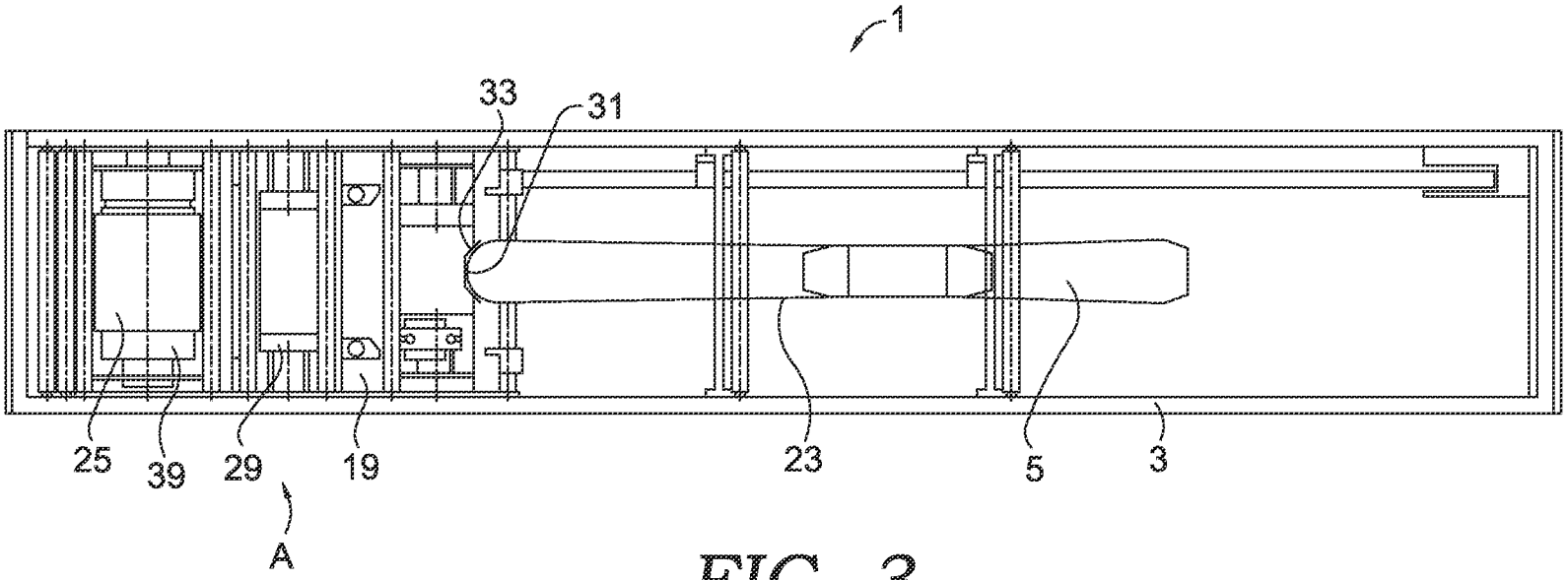
FIG. 3 shows a horizontal section through the system along the line III-III in FIG. 1.
Figure 4:
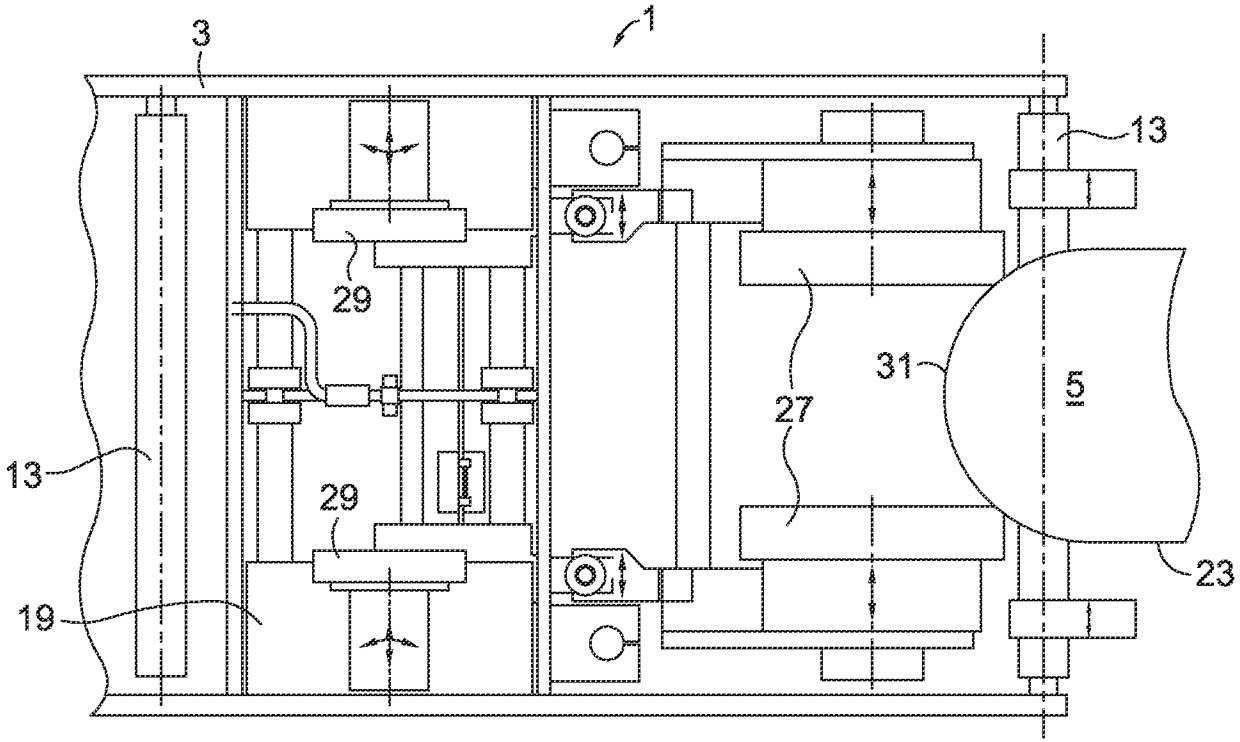
FIG. 4 shows an enlarged view of area A in FIG. 3.

With a programmable control system, the functions of the different grinding disks 25, 27 and 29 as well as their heights and lateral positions during the machining of a ski 5 can be controlled individually or together. The lateral movement towards the ski 5 is controlled by distance sensors so that the contour of the ski 5 need not be known, but rather any arbitrary ski 5, including any new creations, can be processed in system 1. This possibility is also simplified in that the tip 31 of the ski 5 is always placed at a fixed point, which is formed for example by an arc-shaped mount 33 (See FIG. 3).

For the purpose of care and maintenance of the grinding surfaces of the disks 25, 27 and 29, there can be arranged on the machine frame 3 at least one whetting element, e.g., a diamond 35, on a surface planing device 36, which on the one hand can be lowered from above on the jacket of the sliding surface and structure-grinding disk 25 and the jackets of the tuning grinding disks 27 and can be displaced parallel to their axes of rotation or to the surfaces. In a particularly advantageous embodiment of the surface planing device 36, the diamonds 35 have, in the direction to the cutting tip, at least one bore for the passage of cooling water. On the one hand, this allows an optimal cooling of the diamond 35 and, on the other, it increases its service life. The diamond 35 can create not only smooth surfaces lying at the desired angle on the grinding disks, but it can also insert grooves in the surfaces of the grinding disks, which create a special grinding pattern on the bottom 21 of the processed ski 5.

In the area of the lower apex $S_u$ of the grinding disks, nozzles 37 can be arranged for the passage of water to clean the grinding disk surfaces. The nozzles 37 are aligned directly and at an appropriate angle to the lateral surfaces of the grinding disks so that grinding dust and any debris from the surface can be removed. With each rotation of the grinding disk, it is cleaned and therefore is clean and not clogged so that the grinding effect is always consistent.

The functioning of the system 1 will now be shortly explained. After placing a ski 5 to the carrier roller 13 located right of the carriages 19 and the pushing of the ski tip 31 into the mount 33, the ski 5 is pressed by the pressing cylinder 9 from the top onto the carrier roller 13 and thus its bottom 21 is linearly aligned. The ski 5 is held in its clamped position. Subsequently, the carriage 19 begins to ride from its parking position (left side in the machine frame 3) to the right. It is cogged here by the side-mounted belt 17 without clearance. First, the sliding surface- and structure-grinding disk 25 comes in contact in the area of the tip of the ski 5 with the bottom 21 and is pressed, by the pressing means (not shown) having a predetermined and controlled contact force, to the bottom 21. In this first passage, wherein the carriage 19 drives from its left position to a right position, the other two grinding disks 29 and 27 are not in contact with the ski 5.

When driving the carriage 19, the carrier roller 13 located to the left side of the grinding disk 27 arrives under the ski and supports it. During the further movement to the right, the other carrier rollers 13 on the carriage 19 and those on the left of the carriage 19 also arrive under the bottom 21 of the ski 5 the two carrier rollers 13 (to the right of the carriage 19), which at the beginning were carrying the ski 5, leave to the right the bottom 21 of the ski 5 and are joined together. While the carriage 19 is moving to the right side, the two carrier rollers 13 previously arranged on the left side of the carriage 19 and closely adjacent carrier rollers 13 are coupled to the cogged belt 17 and carried along and, at predetermined positions, again decoupled, in order to support the ski 5 even in the present position. During a working passage of the carriage 19 from the left to the right, the ski is therefore constantly supported by a plurality of rollers 13, but not always by the same carrier rollers 13.

Upon return of the carriage 19 from its position on the right side, the two grinding disks 29 and 27, i.e., the tuning grinding disk 27, which machines the edge underside, and the grinding cup 29, which machines the edge outer surface, come into engagement after having previously been placed in the correct position by the controller or the sensors. Of course, if necessary, the sliding surface- and structure-grinding disk 25 can machine again the bottom 21 during the retraction. During the return movement, as before the carrier rollers 13 on the left side, now the carrier rollers 13 on the right side of the carriage 19 are connected by the clamping elements 20 to the cogged belt 17 so that the ski 5 is always and at approximately constant intervals supported from the bottom such that the vertical position of the bottom 21 of the ski 5 always remains in the spatially exactly same position. Of course, the positions of the carrier rollers 13 in relation to the ski 5 can be set up by distance sensors so that regardless of the length of the ski, the latter is always supported at regular intervals.

In a further advantageous embodiment of the invention, in the lateral bearings, in particular of the sliding surface- and structure-grinding disk 25, there can be arranged means 39 in order to determine an unbalance, which may occur due to wear of the grinding disk 25. After detecting an unbalance, either balancing weights can be attached to an appropriate place on the grinding disk 25 or already mounted balance weights are shifted accordingly and re-fixed at an appropriate point of the grinding disk.

The need for scraping the surfaces of the grinding disks can be determined at fixed time intervals depending on the number of the processed skis 5 or by sensors, which detect irregularities.

On the carriage 19, there can be arranged, if desired, in addition to the grinding disks, also embossing devices, which stamp into the bottom 21 of the ski 5 suitable structures. This can be done with heated embossing rolls or by heating and subsequent embossing the softened surface.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. System for machining the running surface and the edges on skis and snowboards, comprising a machine frame for securing the machining tools and the holding elements for the skis or snowboards during the machining of their running surface and edges, wherein the skis or snowboards during the machining are held stationary by the support element and the machining tools are movable in the machine frame on a carriage in the longitudinal direction of the skis, comprising:

a motor-driven sliding surface- and structure-grinding disk arranged on the carriage, and designed to machine the bottom;

two tuning grinding disks designed to machine the edge underside, arranged on the carriage, of which at least one is axially displaceable relative to the other one; and two cup wheels designed to machine the outer surfaces of the edges arranged on the carriage, of which at least one is axially displaceable relative to the other one.

2. The system according to claim 1, wherein the holding elements for the skis comprise carrier rollers that are movably arranged transversely to the direction of travel of the carriage, which carrier rollers are partly mounted on the carriage laterally and parallel to the machining tools, and partly on stands in front of and behind the carriage on the machine frame.

3. The system according to claim 2, wherein the stands with the carrier rollers are displaceable by a flexible band or cogged belt, wherein the stands can be entrained because they can be coupled to and again uncoupled from the band or cogged belt.

4. The system according to claim 2, further comprising at least one hold-down device attached on top of the machine frame, and adapted to press a ski against the carrier rollers until their bottom lies in a plane.

5. The system according to claim 1, wherein the grinding disks can be brought up from below and pressed, with adjustable and controlled force, to the bottom of the ski.

6. The system according to claim 1, wherein the position of the rotational axes of the grinding cup wheel and/or the tuning grinding disk to the horizontal is adjustable manually or by a motor.

7. The system according to claim 1, wherein for profiling or scraping of the grinding disks, on the machine frame there is arranged one or more scraping elements or diamonds, to which the grinding disks can be driven.

8. The system according to claim 7, wherein for cleaning the grinding disks of abrasive dust and any debris, pressure water nozzles are arranged in the area of each lower apex of the grinding disks, said nozzles are directed to the surfaces of the grinding disks.

* * * * *